US009818396B2

(12) United States Patent
Tachibana et al.

(10) Patent No.: US 9,818,396 B2
(45) Date of Patent: Nov. 14, 2017

(54) METHOD AND DEVICE FOR EDITING SINGING VOICE SYNTHESIS DATA, AND METHOD FOR ANALYZING SINGING

(71) Applicant: Yamaha Corporation, Hamamatsu-shi, Shizuoka-ken (JP)

(72) Inventors: Makoto Tachibana, Hamamatsu (JP); Masafumi Yoshida, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/215,882

(22) Filed: Jul. 21, 2016

(65) Prior Publication Data

US 2017/0025115 A1 Jan. 26, 2017

(30) Foreign Application Priority Data

Jul. 24, 2015 (JP) ..... 2015-146889
May 23, 2016 (JP) ..... 2016-102192

(51) Int. Cl.
*G10L 13/00* (2006.01)
*G10L 13/033* (2013.01)
*G10L 13/08* (2013.01)

(52) U.S. Cl.
CPC .... *G10L 13/0335* (2013.01); *G10L 2013/083* (2013.01)

(58) Field of Classification Search
USPC ..... 704/257–275
See application file for complete search history.

(56) References Cited

U.S. PATENT DOCUMENTS 5,621,182 A * 4/1997 Matsumoto ..... G10H 1/366 434/307 A
2005/0137862 A1* 6/2005 Monkowski ..... G10L 15/06 704/222
2009/0306987 A1* 12/2009 Nakano ..... G10H 1/366 704/260
2010/0175539 A1* 7/2010 Silbert ..... G10H 1/0066 84/612
2015/0025892 A1* 1/2015 Lee ..... G10L 21/003 704/267
2015/0040743 A1 2/2015 Tachibana

FOREIGN PATENT DOCUMENTS

JP 2015-34920 A 2/2015

* cited by examiner

*Primary Examiner* — Jesse Pullias
(74) *Attorney, Agent, or Firm* — Crowell & Moring LLP

(57) ABSTRACT

A singing voice synthesis data editing method includes adding, to singing voice synthesis data, a piece of virtual note data placed immediately before a piece of note data having no contiguous preceding piece of note data, the singing voice synthesis data including: multiple pieces of note data for specifying a duration and a pitch at which each note that is in a time series, representative of a melody to be sung, is voiced; multiple pieces of lyric data associated with at least one of the multiple pieces of note data; and a sequence of sound control data that directs sound control over a singing voice synthesized from the multiple pieces of lyric data, and obtaining the sound control data that directs sound control over the singing voice synthesized from the multiple pieces of lyric data, and that is associated with the piece of virtual note data.

5 Claims, 7 Drawing Sheets

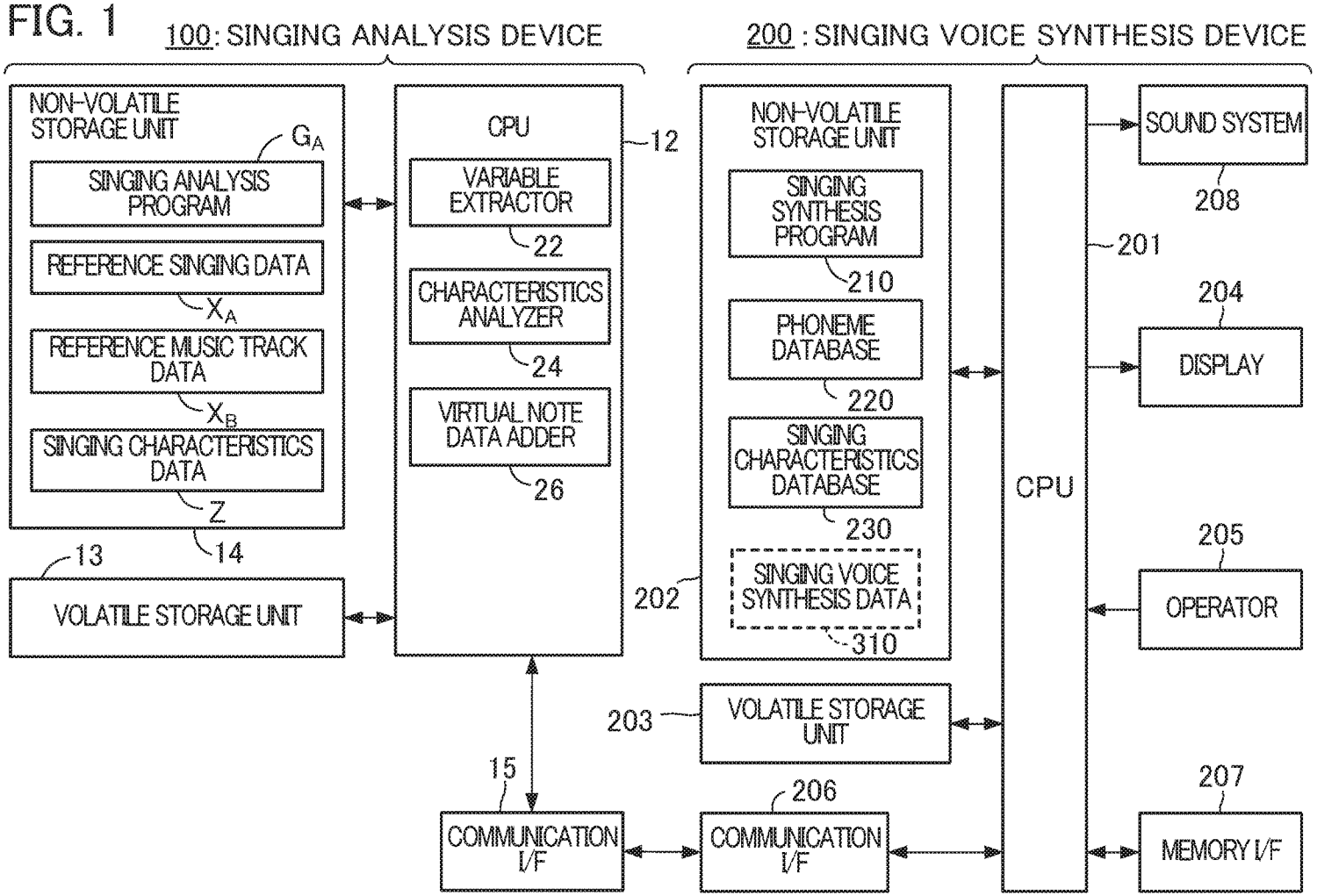
FIG. 1
100: SINGING ANALYSIS DEVICE
NON-VOLATILE STORAGE UNIT
SINGING ANALYSIS PROGRAM
$G_A$
REFERENCE SINGING DATA
$X_A$
REFERENCE MUSIC TRACK DATA
$X_B$
SINGING CHARACTERISTICS DATA
Z
14
13
VOLATILE STORAGE UNIT
CPU
12
VARIABLE EXTRACTOR
22
CHARACTERISTICS ANALYZER
24
VIRTUAL NOTE DATA ADDER
26
15
COMMUNICATION I/F
200 : SINGING VOICE SYNTHESIS DEVICE
NON-VOLATILE STORAGE UNIT
SINGING SYNTHESIS PROGRAM
210
PHONEME DATABASE
220
SINGING CHARACTERISTICS DATABASE
230
SINGING VOICE SYNTHESIS DATA
310
202
VOLATILE STORAGE UNIT
203
COMMUNICATION I/F
206
CPU
201
SOUND SYSTEM
208
DISPLAY
204
OPERATOR
205
MEMORY I/F
207

METHOD AND DEVICE FOR EDITING SINGING VOICE SYNTHESIS DATA, AND METHOD FOR ANALYZING SINGING

BACKGROUND OF THE INVENTION

1. Field of the Invention

The present invention relates to a method and device for editing singing voice synthesis data that directs control over synthesis of a singing voice. The invention also relates to a method for analyzing a singing voice that generates singing characteristics data used for editing singing voice synthesis data.

2. Description of the Related Art

There is known in the art of singing voice synthesis, a technique of synthesizing a singing voice based on singing voice synthesis data. The term singing voice synthesis data referred to here is sequence data including note data specifying a duration and pitch of a voice, and lyrics data associated with the note data, and sound control data. Examples of kinds of data included in the sound control data are volume control data for controlling a volume of a voice outputting lyrics indicated by the lyrics data, and pitch control data for controlling a pitch of the voice.

The singing voice synthesis data may be freely edited by a user and stored in a memory. The different kinds of data constituting the singing voice synthesis data, i.e., each of the pieces of note data, the lyrics data associated with each piece of note data, and the sound control data are read out from a memory in a sequential manner and supplied to a singing voice synthesizer by a sequencer. The singing voice synthesizer synthesizes singing voice signals that correspond to the lyrics indicated by the lyrics data, which are supplied by the sequencer, and have a pitch and voicing duration specified by the note data. The singing voice synthesizer then performs sound control such as volume and pitch control on the singing voice signals based on the sound control data, for output.

When an actual person sings, the first voicing of a phrase segmented by silent sections strongly characterizes the singer. One may desire that singing be made much more expressive by varying both volume and pitch at a start of a phrase. Japanese Patent Application Laid-Open Publication No. 2015-034920 (JP 2015-034920, hereinafter) discloses a technology in which a probability model is used to machine learn a relationship between pitch transitions of synthesized singing represented by reference music track data consisting of a combination of note data and lyrics data of a particular music track, with pitch transitions of reference singing data being obtained by actually singing the particular music track. Singing characteristics data that define the probability model are then generated.

One possibility for making singing more expressive is to generate singing characteristics data by using the technology of JP 2015-034920, and further generating sound control data to impart variation in a pitch and volume at a beginning of a phrase based on the singing characteristics data. In the technology of JP 2015-034920, however, the section for which the probability model performs machine learning is determined based on the note data of the reference music track data. Consequently, the technology of JP 2015-034920 is not able to obtain singing characteristics data that could be used to enhance musical expressivity in a section immediately before note-on, since the technology interprets such a section as a silent section, and thus differentiates the section from a voiced section.

SUMMARY OF THE INVENTION

The present invention has been made in view of the abovementioned situation, and one of the objects of the invention is to provide a method and device for editing singing voice synthesis data so as to impart enhanced musical expressiveness to singing at a beginning of a phrase. Another object of the invention is to provide an improved method for analyzing singing and to increase utility of a method in editing singing voice synthesis data and a device used for realizing the method.

A singing voice synthesis data editing method according to one aspect of the present invention includes adding to singing voice synthesis data, a piece of virtual note data that is placed immediately before a piece of note data having no contiguous preceding piece of note data, the singing voice synthesis data including: multiple pieces of note data each specifying a duration and a pitch at which each note that is in a time series, representative of a melody to be sung, is voiced; multiple pieces of lyrics data associated with at least one of the multiple pieces of note data; and a sequence of sound control data for directing sound control over a singing voice that is synthesized from the multiple pieces of lyrics data. The method additionally includes obtaining sound control data that directs sound control over the singing voice synthesized from the multiple pieces of lyrics data, and that is associated with the piece of virtual note data. The above method may also be embodied as a device for editing singing voice synthesis data.

When there is a piece of note data that has no contiguous preceding piece of note data, such as at the beginning of a phrase, the method or device for editing singing voice synthesis data of the present invention adds to the singing voice synthesis data a piece of virtual note data that is placed immediately before the note data that does not have any contiguous preceding piece of note data. Sound control data associated with the piece of virtual note data is then obtained. Accordingly, it is possible to implement sound control by the sound control data for the section before the first note-on timing of a phrase, whereby singing at the beginning of the phrase is made expressive.

A singing analysis method according to another aspect of the present invention includes generating singing characteristics data based on music track data that includes multiple pieces of note data each specifying a duration and a pitch at which each note that is in a time series, representative of a melody to be sung, is voiced, with multiple pieces of lyrics data associated with at least one of the multiple pieces of note data, as well as singing data indicating a singing voice waveform obtained by singing the music track. The generated singing characteristics data defines a probability model for generation of singing data from the music track data. The singing analysis method also includes adding, to the music track data from which the singing characteristics data is generated, a piece of virtual note data placed immediately before a piece of note data having no contiguous preceding piece of note data, among the multiple pieces of note data. The singing analysis method may be embodied as a singing analysis device that executes such singing analysis method.

According to this method or device for analyzing singing, singing characteristics data are generated based on the music track data to which the piece of virtual note data has been added. Consequently, by using the obtained singing characteristics data, the aforementioned method or device for editing singing voice synthesis data enables generation of sound control data appropriate for the piece of virtual note data that has been added.

BRIEF DESCRIPTION OF THE DRAWINGS

FIG. 1 is a block diagram illustrating a singing voice synthesis system according to one embodiment of the present invention, the system including a singing voice synthesis device and a singing analysis device, the singing voice synthesis device functioning as a singing voice synthesis data editing device and the singing analysis device providing the singing voice synthesis device with singing characteristics data.

DESCRIPTION OF THE EMBODIMENTS

Figure 2:
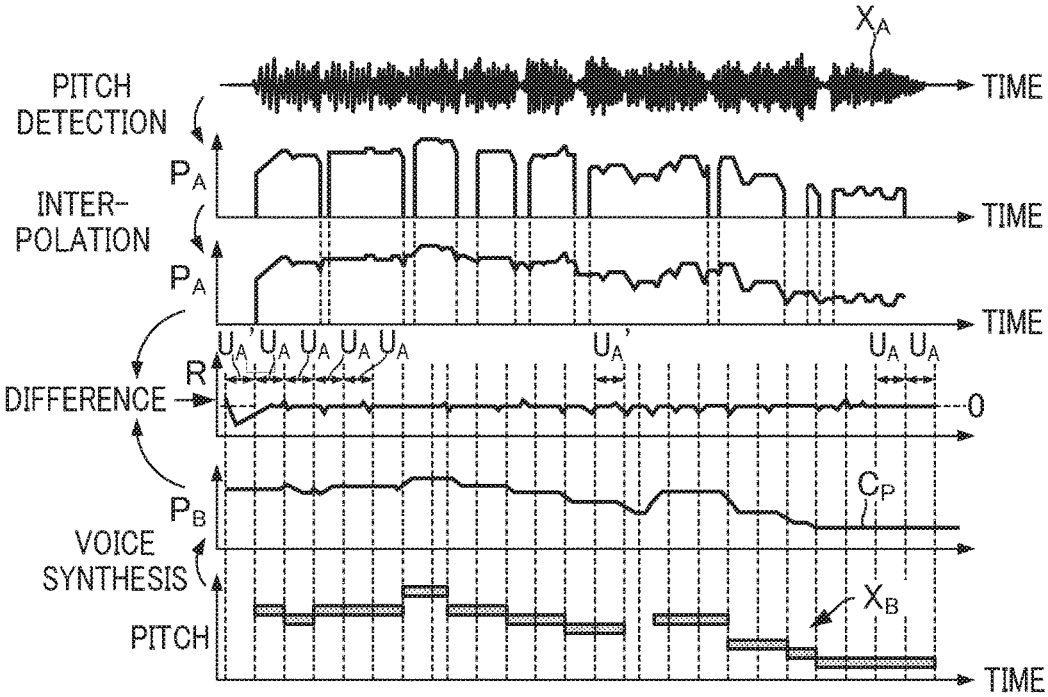
FIG. 2 is a diagram showing an operation of a variable extractor of the singing analysis device.

An embodiment of the invention will be described below, referring to the drawings.

FIG. 1 is a block diagram showing a configuration of a singing voice synthesis system, which is one embodiment of the invention. As FIG. 1 illustrates, the singing voice synthesis system includes a singing voice synthesis device 200 and a singing analysis device 100 that supplies singing characteristics data to the singing voice synthesis device 200.

The singing analysis device 100 generates singing characteristics data Z that represents the singing style of a particular singer (hereinafter the "reference singer"). Singing style as used here means a manner of expression including the way of singing that is distinctive to the reference singer (for example, note bending) and facial expressions. The singing voice synthesis device 200 executes singing voice synthesis incorporating singing characteristics data Z generated by the singing analysis device 100, and then generates singing voice signals of a singing voice of any music track that reflects the singing style of the reference singer. In other words, even when the singing voice of the reference singer is not available for a desired music track, the singing voice synthesis device 200 may generate a singing voice of the subject music track with the singing style of the reference singer attributed thereto (i.e., a voice sounding as if the reference singer is actually singing the music track).

Singing Analysis Device 100

The singing analysis device 100 has a CPU 12, a volatile storage unit 13, a non-volatile storage unit 14 and a communication interface (I/F) 15. The non-volatile storage unit 14 is formed of, for example a read-only memory (ROM) or a hard disc device (HDD), and stores reference singing data $X_A$ and reference music track data $X_B$ that are used to generate singing characteristics data Z. The reference singing data $X_A$ represents the waveform of the voice of the reference singer singing a particular music track as shown as an example in FIG. 2. Hereinafter, this voice of the reference singer will be referred to as "the reference voice", and the particular music track will be referred to as "the reference music track". The reference music track data $X_B$ represents the score of the reference music track corresponding to the reference singing data $X_A$. Specifically, as understood from FIG. 2, the reference music track data $X_B$ is sequence data, for example a VSQ format file, that designates in time series each of pitch, voicing duration and lyrics (pronounced letters) for each musical note contained in the reference music track. In other words, the reference music track data $X_B$ includes: multiple pieces of note data each specifying the duration and the pitch at which each note is voiced; and multiple pieces of lyrics data associated with at least one of the multiple pieces of note data.

By executing a singing analysis program GA stored in the non-volatile storage unit 14, the CPU 12 achieves multiple functions for generating the singing characteristics data Z of the reference singer (a variable extractor 22, a characteristics analyzer 24, and a virtual note data is adder 26). The singing analysis program GA may be provided in a form stored in a computer-readable storage medium and be installed in the singing analysis device 100.

Such storage medium and the non-volatile storage unit 14 are, for example, non-transitory recording media, and they may be any publicly known recording media such as optical recording media (optical discs) such as a CD-ROM, magnetic recording media and semiconductor recording media. "Non-transitory" recording media mentioned in the description of the present invention include all types of recording media that may be read by a computer, except for transitory, propagating signals, and they do not exclude volatile recording media. The singing analysis program GA may alternatively be provided in a form distributed through a communication network and be installed onto a computer.

Figure 3:
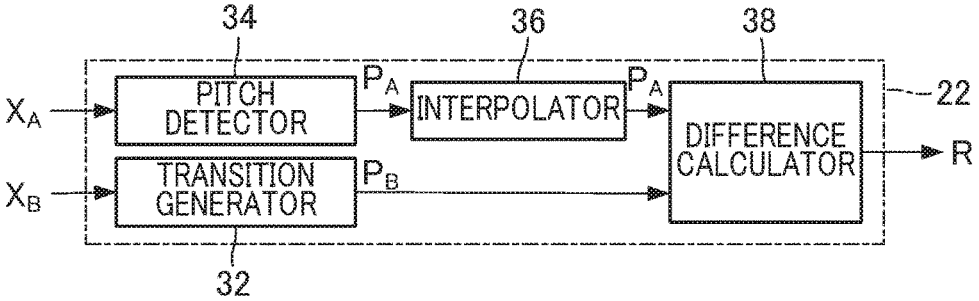
FIG. 3 is a block diagram showing a functional configuration of the variable extractor.

The variable extractor 22 obtains from the reference singing data $X_A$, a sequence of feature quantities of the reference voice. In this example, the variable extractor 22 sequentially calculates, as the feature quantity, a difference (hereinafter, a relative pitch) R that is the difference between a pitch $P_B$ of the synthetic voice generated through voice synthesis using the reference music track data $X_B$, and a pitch $P_A$ of the reference voice represented by the reference singing data $X_A$. In other words, the relative pitch R may be also referred to as the numerical value of the pitch bend of the reference voice (the amount the pitch $P_A$ of the reference sound varies against the pitch $P_B$ of the synthetic voice that serves as a benchmark). As shown in FIG. 3, the variable extractor 22 includes a transition generator 32, a pitch detector 34, an interpolator 36 and a difference calculator 38.

The transition generator 32 sets a transition (hereinafter, synthetic pitch transition) $C_P$ of the pitch $P_B$ of the synthetic voice generated through voice synthesis using the reference music track data $X_B$. In phoneme-connecting voice synthesis using the reference music track data $X_B$, the synthetic pitch transition (pitch curve) $C_P$ is generated according to the pitch and voicing duration specified by the reference music track data $X_B$ for each note, and the phonemes corresponding to the lyrics of respective notes are tuned to each pitch $P_B$ of the synthetic pitch transition $C_P$ and inter-connected, whereby a synthetic voice is generated. The transition generator 32 generates the synthetic pitch transition $C_P$ according to the reference music track data $X_B$ of the reference music track. As will be understood from the above, the synthetic pitch transition $C_P$ corresponds to the locus of the model. (standard) pitch $P_B$ of the voice singing the reference music track.

It is of note that whereas the synthetic pitch transition $C_P$ may be used in voice synthesis as mentioned above, actual generation of a synthetic voice is not necessary with the singing analysis device 100 as long as the synthetic pitch transition $C_P$ corresponding to the reference music track data $X_B$ is generated.

FIG. 2 shows the synthetic pitch transition $C_P$ generated from the reference music track data $X_B$. As FIG. 2 shows, the pitch specified by the reference music track data $X_B$ for each note varies discretely (discontinuously) whereas the pitch $P_B$ of a synthetic pitch transition $C_P$ of a synthetic voice varies in a continuous manner. That is, the pitch $P_B$ of a synthetic voice continuously changes from the numerical value of the pitch of any one note to the numerical value of the pitch of an immediately subsequent note. As will be understood from the above, the transition generator 32 generates the synthetic pitch transition $C_P$ that indicates the pitch $P_B$ of a synthetic voice that continuously varies along the time axis.

The pitch detector 34 of FIG. 3 sequentially detects the pitch $P_A$ of the reference voice represented by the reference singing data $X_A$. For such detection of the pitch $P_A$, commonly known techniques are used as appropriate. As will be understood from FIG. 2, within the reference voice, no pitch $P_A$ is detected in an unvoiced section (consonant section or silent section for example) in which no harmonic structure is present. The interpolator 36 of FIG. 3 sets (interpolates) the pitch $P_A$ for this unvoiced section of the reference sound.

Figure 4:
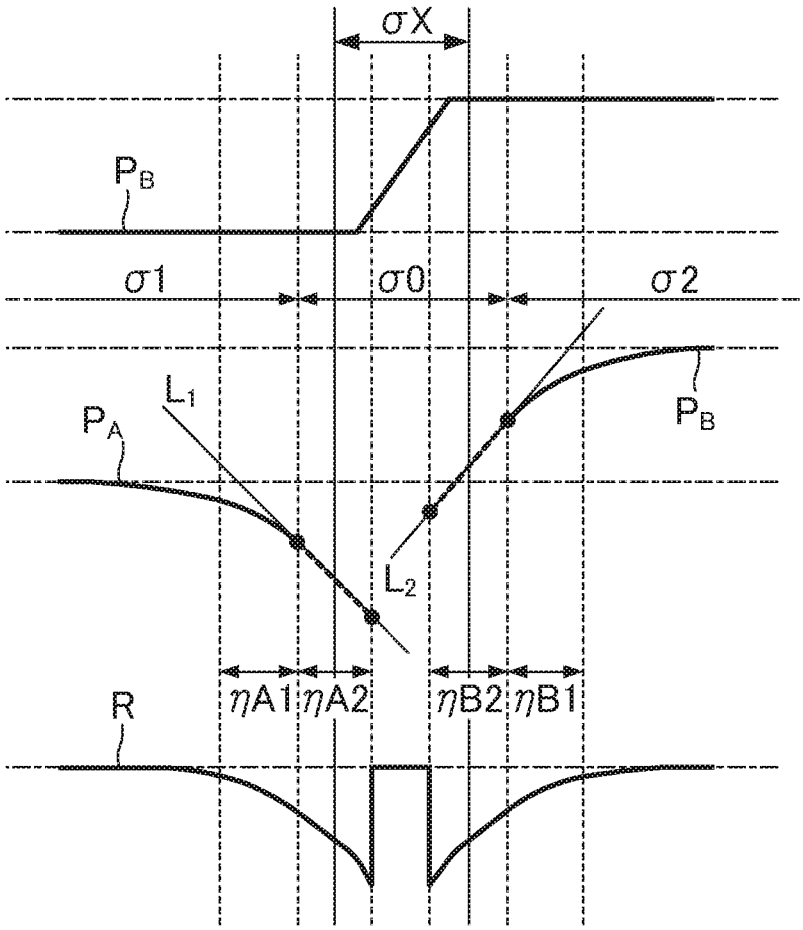
FIG. 4 is a diagram showing an operation of an interpolator of the singing analysis device.

FIG. 4 is a diagram explaining the operation of the interpolator 36. As an example, in FIG. 4 there is shown a voiced section σ1 and a voiced section σ2 from which the pitch $P_A$ of the reference voice is detected, as well as an unvoiced section (consonant section or silent section) σ0. The interpolator 36 sets the pitch $P_A$ in the unvoiced section σ0 according to the sequential pitch $P_A$ that extends across the voiced section σ1 and the voiced section σ2.

Specifically, the interpolator 36 sets a sequence of the pitch $P_A$ in an interpolated section (a first interpolated section) ηA2, of a predetermined length, of the unvoiced section σ0, the first interpolated section ηA2 residing at the starting side of the unvoiced section σ0, based on a sequence of the pitch $P_A$ in a section (a first section) ηA1, of a predetermined length, of the voiced section σ1, the first section ηA1 residing at the ending side of the voiced section σ1. For example, the interpolator 36 sets numerical values along an approximate line (regression line for example) L1 of the sequence of the pitch $P_A$ in the section ηA1, as the pitch $P_A$ in the interpolated section ηA2 that is immediately subsequent to the section ηA1. In other words, the sequence of the pitch $P_A$ in the voiced section σ1 is extended into the unvoiced section σ0 such that the transition of the pitch PA is continuous across the voiced section σ1 (section ηA1) and the immediately subsequent unvoiced section σ0 (interpolated section ηA2).

Similarly, the interpolator 36 sets a sequence of the pitch $P_A$ in an interpolated section (a second interpolated section) ηB2, of a predetermined length, of the unvoiced section σ0, the second interpolated section ηB2 residing at the ending side of the unvoiced section σ0, based on a sequence of the pitch $P_A$ in a section (a second section) ηB1, of a predetermined length, of the voiced section σ2, the second section ηB1 residing at the starting side of the voiced section σ2. For example, the interpolator 36 sets each numerical value along an approximate line (a regression line for example) L2 of the sequence of the pitch $P_A$ within the section ηB1 as the pitch $P_A$ within the interpolated section ηB2 that immediately precedes the section ηB1. In other words, the sequence of the pitch $P_A$ within the voiced section σ2 is extended into the unvoiced section σ0 so that the transition of the pitch $P_A$ is continuous across the voiced section σ2 (section ηB1) and the immediately preceding unvoiced section σ0 (interpolated section ηB2). The section ηA1 and the interpolated section ηA2 are set to have the same time duration with each other, and the section ηB1 and the interpolated section ηB2 are also set to have the same time duration with each other. It is, however, of note that each section may have a time duration different from one another. In addition, the time duration of the section ηA1 and that of the section ηB1 may or may not be the same, and the time duration of the interpolated section ηA2 and that of the interpolated section ηB2 also may or may not be the same.

As shown in FIGS. 2 and 4, the difference calculator 38 of FIG. 3 sequentially calculates, as the relative pitch R, the difference between the pitch $P_B$ of the synthetic voice (synthetic pitch transition $C_P$), calculated by the transition generator 32, and the pitch $P_A$ of the reference voice that has been processed by the interpolator 36 ($R=P_B-P_A$). As FIG. 4 exemplifies, when the interpolated section ηA2 and the interpolated section ηB2 are separated with each other with a gap therebetween within the unvoiced section σ0, the difference calculator 38 sets the relative pitch R that is in the gap between the interpolated section ηA2 and the interpolated section ηB2, to a predetermined value (for example, 0). Through such configuration and processing, the variable extractor 22 generates a sequence of the relative pitches R.

Figure 5:
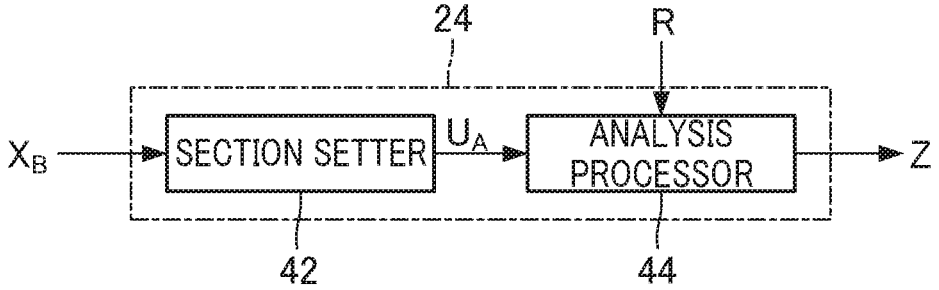
FIG. 5 is a block diagram showing a configuration of a characteristics analyzer of the singing analysis device.

The characteristics analyzer 24 of FIG. 1 generates the singing characteristics data Z by analyzing the sequence of the relative pitches R generated by the variable extractor 22. The characteristics analyzer 24 includes a section setter 42 and an analysis processor 44 as shown in FIG. 5.

The section setter 42 segments the sequence of the relative pitches R, which has been generated by the variable extractor 22, into multiple sections (hereinafter, unit sections) $U_A$ along the time axis. More specifically and as understood from FIG. 2, the section setter 42 segments the sequence of is the relative pitches R into multiple unit sections $U_A$ along the time axis by units of predetermined sound value (hereinafter, unit sound value). The specific operation of the section setter 42 will be described later in further details with reference to the flowchart of FIG. 8. One unit section $U_A$ is, for example, 120 ticks, which is equivalent to the time length of a sixteenth note, and one unit section $U_A$ contains a sequence of the relative pitches R throughout a section that corresponds to a single sound value within the reference music track. The section setter 42 sets multiple unit sections $U_A$ within the reference music track by referring to the reference music track data $X_B$. Here, the time length of one unit section $U_A$ is not limited to that of a sixteenth note (120 ticks), but can be equal to that of any other note. Alternatively, it can be of any freely chosen time length, regardless of whether or not it corresponds to a note length.

Furthermore, the section setter 42 associates the following information with each of the multiple unit sections $U_A$:

(a) tempo information on the entire music track;

(b) phrase information including the number of notes in a phrase, the note numbers of the maximum, minimum and most frequent notes in a phrase, the note number of the first note in a phrase, and the number of short rests (rests shorter than the length of a phrase) in a phrase;

(c) note information (information on the note to which the relevant unit section belongs, as well as the preceding and subsequent notes) including the note number, the note length (number of unit sections included), and the kinds of phonemes included; and (d) unit section information including the placement of the unit section within a note, either seen from the start of a note or from the end of a note.

A phrase here stands for a section in the reference music track corresponding to a melody (a sequence of notes) that the listener recognizes as a cohesive unit of music. The unit section $U_A$ set by the section setter 42 is thus distinguished from a phrase. For example, the reference music track may be segmented into phrases with silent sections as the boundaries, the silent sections having a time length longer than a predetermined time length (for example, a fourth-note rest or longer).

Figure 6:
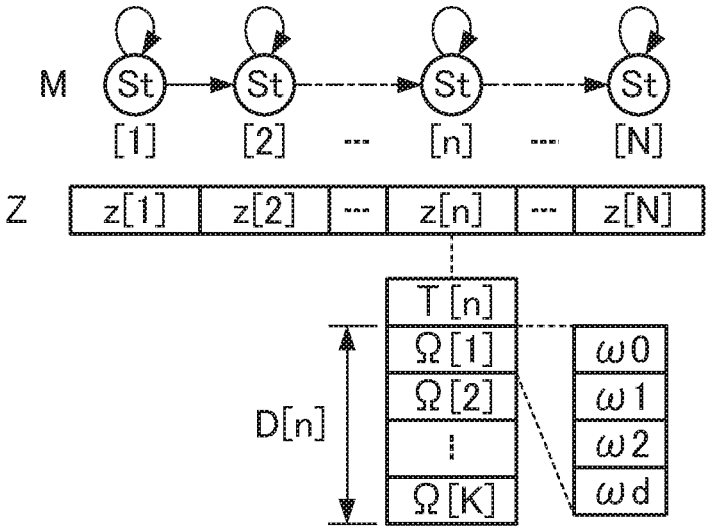
FIG. 6 is a diagram showing a probability model and singing characteristics data associated with the singing analysis device.

The analysis processor 44 of FIG. 5 generates the singing characteristics data Z of the reference singer according to the relative pitch R generated by the section setter 42 for every unit section $U_A$. For such generation of the singing characteristics data Z, a probability model M of FIG. 6 is used. This probability model M is a Hidden Semi Markov Model (HSMM) defined by an N number (N being a natural number of 2 or more) of states St. As exemplified in FIG. 6, the singing characteristics data Z contains an N number of unit data z[n] (z[1] to z[N]) corresponding to the different states St of the probability model M. One unit data z[n] that corresponds to the n-th state St (n=1 to N) of the probability model M includes a decision tree T[n] and variable information D[n].

Figure 7:
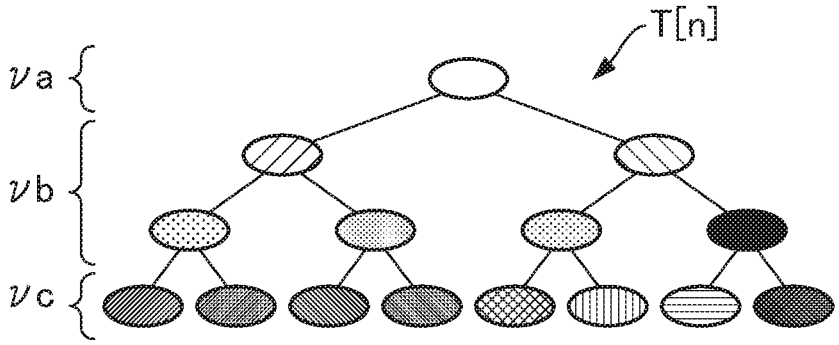
FIG. 7 is a diagram explaining a decision tree associated with the singing analysis device.

The analysis processor 44 generates the decision tree T[n] through machine learning (decision tree learning) in which whether or not predetermined conditions (queries) related to the unit sections $U_A$ are met is sequentially determined. The decision tree T[n] is a classification tree that puts (clusters) the unit sections $U_A$ into clusters, and the decision tree T[n] is expressed in a tree structure in which nodes v (va, vb, and vc) are connected to one another over multiple levels. As shown in FIG. 7, the decision tree T[n] includes: a start node (or root node) va that is at the start of the classification process; multiple (a K number of) end nodes (or leaf nodes) vc that are at the end of the classification process; and intermediate nodes (internal nodes) vb placed at the branching points on the route between the start node va and each end node vc.

At the root node va and the intermediate nodes vb, whether or not such conditions as the following (contexts) are net is determined: whether or not the unit section $U_A$ is a silent section; whether or not a note in the unit section $U_A$ is shorter than a sixteenth note; whether or not the unit section $U_A$ is on the starting side of a note; or whether or not the unit section $U_A$ is on the ending side of a note. The time point at which to terminate the classification of each unit section $U_A$ (the timing at which the decision tree T[n] is finalized) is determined according to the standard of Minimum Description Length (MDL) for example. The structure of the decision tree T[n] (such as the number of intermediate nodes vb and the conditions set thereat, as well as the K number of the end nodes ye) differs for each of the states St of the probability model M.

The variable information D[n] of the unit data z[n] in FIG. 6 is information regulating variables (probabilities) related to the n-th state St of the probability model M. As shown in FIG. 6, such variable information D[n] includes a K number of variable groups Ω[k] (Ω[1] to Ω[K]), each of which corresponds to respective ones of the mutually different end nodes vc of the decision tree T[n]. The k-th (k=1 to K) variable group Ω[k] of the variable information D[n] is a cluster of variables corresponding to the relative pitches R in each of the unit sections $U_A$ that has been classified as the k-th end node vc among the K number of end nodes vc in the decision tree T[n]. Such variable group Ω[k] includes a variable ω0, a variable ω1, a variable ω2 and a variable ωd. The variable ω0, the variable ω1, and the variable ω2 are each a variable that defines the probability distribution of the appearance probability related to the relative pitch R (for example, the average and dispersion of the probability distribution). In detail, the variable ω0 defines the probability distribution of the relative pitches R, the variable ω1 defines the probability distribution of an alteration over time (differential value) ΔR of the relative pitches R, and the variable ω2 defines a second order differential value $\Delta^2R$ of the relative pitches R. The variable ωd is a variable (for example, the average and dispersion of the probability distribution) that defines the probability distribution of the duration of a state St. The analysis processor 44 sets the variable group Ω[k] (ω0 to ω2, and ωd) of the variable information D[n] of the unit data z[n], such that the appearance probability is at its maximum for the relative pitches R of each of the multiple unit sections $U_A$ that has been classified as the k-th end node vc, of the decision tree T[n] corresponding to the n-th state St of the probability model M. The singing characteristics data Z that includes, for each state St of the probability model M, the decision tree T[n] and the variable information D[n], which have been generated through the above steps, is stored into the non-volatile storage unit 14.

Figure 8:
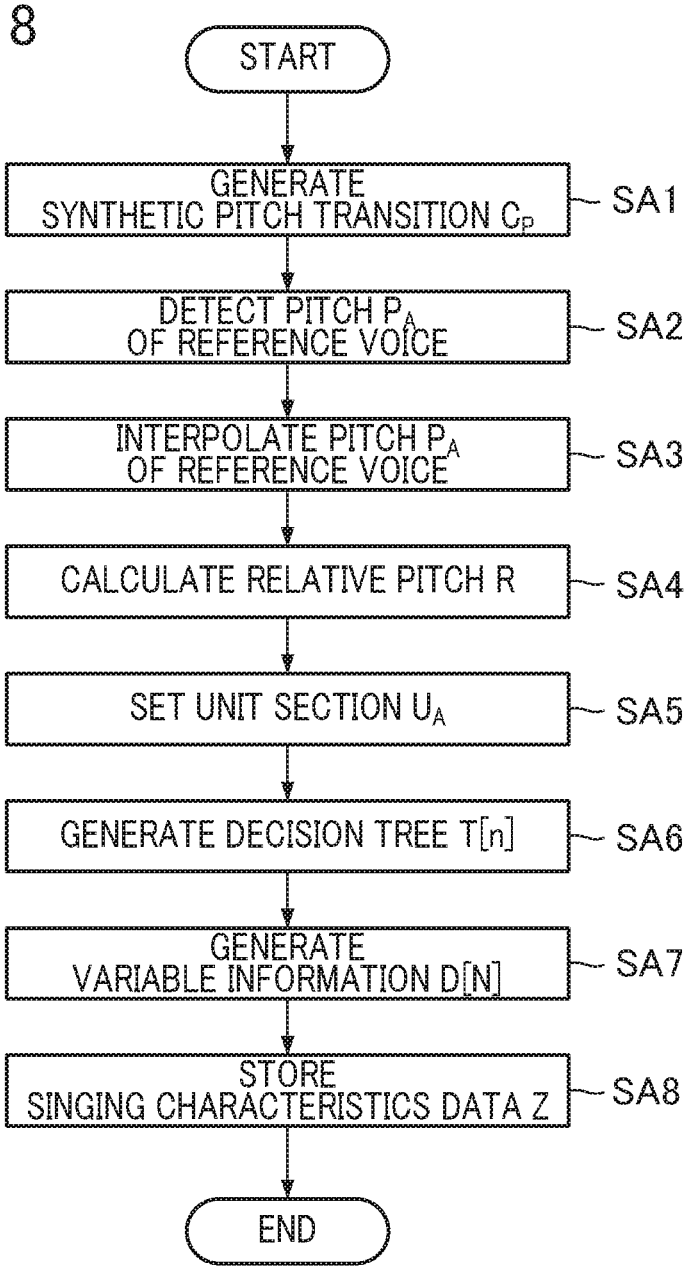
FIG. 8 is a flowchart showing an operation of the singing analysis device.

FIG. 8 is a flowchart indicating the processing details of when the singing analysis program GA is executed by the CPU 12. The singing analysis program GA is activated when the CPU 12 receives an activation order via an operating unit (not shown), or via the communication I/F 15. The activation of the singing analysis program GA causes the transition generator 32 to generate a synthetic pitch transition $C_P$ (pitch $P_B$) from the reference music track data $X_B$ (SA1). The pitch detector 34 detects the pitch $P_A$ of the reference voice represented by the reference singing data $X_A$ (SA2). The interpolator 36 sets the pitch $P_A$ within the unvoiced section of the reference voice through interpolation using the pitch $P_A$ that has been detected by the pitch detector 34 (SA3). The difference calculator 38 calculates, as the relative pitch R, the difference between each pitch $P_B$ that has been generated in step SA1 and each pitch $P_A$ after being interpolated in step SA3 (SA4).

Meanwhile, the section setter 42 segments the reference music track into multiple unit sections $U_A$ for every unit sound value, by referring to the reference music track data $X_B$ (SA5). In doing so, the virtual note data adder 26 first adds virtual note data to the reference music track data $X_B$. The section setter 42 then performs the segmentation by referring to the reference music track data $X_B$ after the virtual note data being added thereto. In other words, when there is a time difference longer than a predetermined duration between the note-off timing of a preceding note and the note-on timing of a subsequent note (such as at the beginning of a phrase), the two notes placed side by side in the reference music track data $X_B$, the virtual note data adder 26 adds a piece of virtual note data that is placed immediately before the subsequent note. The section setter 42 segments multiple notes included in the reference music track data $X_B$ containing one or more pieces of such virtual note data into a predetermined duration (for example, the duration of a sixteenth note), wherein the segmenting is performed, for each and every note, in the order from the beginning of each note to the end of each note.

More specifically, the section setter 42 segments, into unit sections $U_A$, each note, except for virtual notes, included in the reference music track data $X_B$. The section setter 42 also segments, this time into unit sections $U_A'$ that have the same length as the unit sections $U_A$, the notes corresponding to the virtual note data (refer to FIG. 2). The virtual note data is note data that is added to the beginning of the notes originally contained in the reference music track data $X_B$. In this embodiment, the section setter 42 distinguishes between original notes and virtual notes, which the virtual note data represents, and segments each of the original notes and the virtual notes as taken individually. There may exist a case wherein a note cannot be segmented into sections of a predetermined time length. Such a case may occur when a remainder or deficiency is left after dividing the length of a note by a predetermined time length. In this case, for at least one section of the multiple sections within the note, the time length is either extended beyond the predetermined time length or shortened below the predetermined time length.

It is of note that the detailed way of adding the virtual note data is the same as that indicated in FIGS. 12 and 13, explanation of which will be provided later. It also is of note that the below-mentioned processing (preprocessing) in FIG. 11 preferably is performed on the reference music track data $X_B$ prior to addition of the virtual note data. The preprocessing here is processing in which a piece of note data is added immediately after a preceding piece of note data, when the time difference between the note-off timing of the preceding piece of note data and the note-on timing of a piece of subsequent note data is less than or equal to the predetermined value. The length of the added piece of note data corresponds to the relevant time difference. Accordingly, the piece of note data added to the reference music track data $X_B$ through the preprocessing may be handled as the original-note-section in the aforementioned section setting processing.

The analysis processor 44 generates a decision tree T[n] for each state St of the probability model M through machine learning using each unit section ($U_A$ or $U_A'$) (SA6). The analysis processor 44 then generates the variable information D[n] corresponding to the relative pitch R within each unit section ($U_A$ or $U_A'$) that has been classified as an end node vc of the decision tree T[n] (SA7). Subsequently, the analysis processor 44 stores in the non-volatile storage unit 14, the singing characteristics data Z that contains the unit data z[n] for each state St of the probability model M, the unit data z including the decision tree T[n] generated in step SA6 and the variable information D[n] generated in step SA7 (SA8). By repeating the abovementioned steps for every combination of a reference singer (reference singing data $X_A$) and a reference music track data $X_B$, the non-volatile storage unit 14 appropriately stores different sets of singing characteristics data Z respectively corresponding to the mutually differing reference singers.

The above explanation of the functions of the singing analysis device 100 has hereto focused on the generation of the singing characteristics data that indicates a pitch transition. The same method can generally be applied to the generation of singing characteristics data that indicates a volume transition. Unlike the generation of the singing characteristics data that indicates a pitch transition, however, the singing characteristics data that indicates a volume transition does not use the volume characteristics of the reference music track data $X_B$, but rather uses a volume characteristics detected from the reference singing data $X_A$ as it is, as the singing characteristics data.

Singing Voice Synthesis Device 200

In FIG. 1, the singing voice synthesis device 200 according to the present embodiment is achieved when a singing voice synthesis program according to the present embodiment is installed in an information processing device such as a personal computer. As FIG. 1 illustrates, the singing voice synthesis device 200 has a CPU 201 that functions as the control center of the singing voice synthesis device 200, a non-volatile storage unit 202, a volatile storage unit 203, a display 204, an operator 205, a communication I/F 206, a memory I/F 207, and a sound system 208. The non-volatile storage unit 202 includes, for example, a ROM and a hard disc device (HDD) and stores various programs that the CPU 201 executes and various databases that the CPU 201 refers to. The volatile storage unit 203 is a Random Access Memory (RAM) for example, and is used as a working area by the CPU 201. The display 204 is configured to display various types of information under the control of the CPU 201, and is a liquid crystal display panel and driving circuitry thereof for example. The operator 205 is configured to provide the CPU 201 with operation information, and includes various operating units such as a keyboard or a mouse. The communication I/F 206 is a Network Interface Card (NIC) for example, and mediates network communication between the CPU 201 and other devices. The memory I/F 207 reads and writes data out of and into various storage media such as a memory card. The sound system 208 has: a D/A convertor that converts a digital sound signal supplied from the CPU 201 into an analog sound signal, an amplifier that amplifies the analog signal and a speaker driven by the amplifier.

The non-volatile storage unit 202 of the present embodiment stores a singing voice synthesis program 210, a phoneme database 220, and a singing characteristics database 230. The singing voice synthesis program 210 and the phoneme database 220 are read out of a storage media by the memory I/F 207, or received from a network server by the communication I/F 206 for example, and are stored in the non-volatile storage unit 202. The singing characteristics database 230 is made up of the singing characteristics data Z, which is generated by the singing analysis device 100, either by being downloaded via the communication I/F 206 or by being read out of a storage medium having stored thereon the singing characteristics data Z by the memory I/F 207, and then being stored in the non-volatile storage unit 202 for compilation in a database. Each of the storage medium from which the singing voice synthesis program 210 is read out, the non-volatile storage unit 202, and the volatile storage unit 203 may be, for example, non-transitory recording media and they may include optical recording media (optical discs) such as CD-ROMs, or alternatively, any commonly known recording media such as magnetic recording media or semiconductor recording media.

The phoneme database 220 is a collection of phoneme waveform data indicating waveforms of various phonemes, such as consonants and vowels, that are materials forming a singing voice. This phoneme waveform data refers to data based on phoneme waveforms extracted from the waveform of a voice of an actual person. The phoneme database 220 contains groups of phoneme waveform data obtained from singing voice waveforms of different singers having different voice qualities, such as a male voice, a female voice, a clear voice, or a husky voice. The singing voice synthesis program 210 causes the CPU 201 to execute singing voice synthesis using this phoneme database 220, and the singing characteristics database 230.

Figure 9:
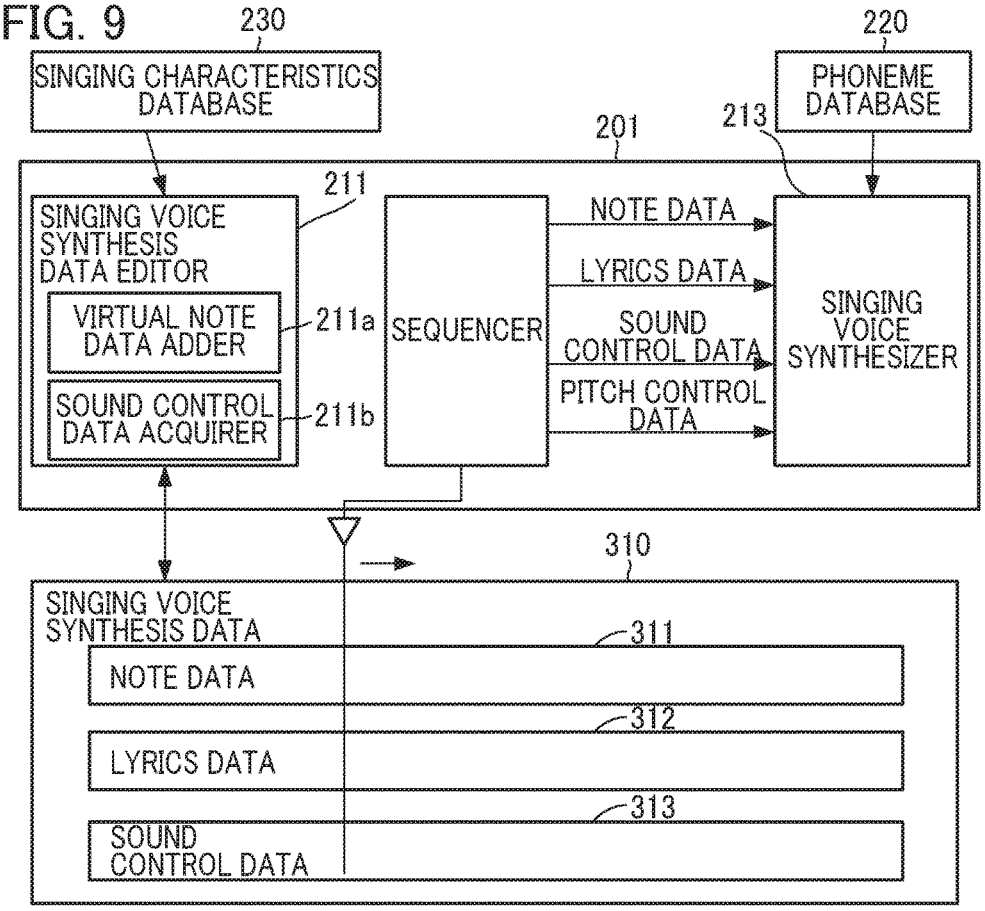
FIG. 9 is a block diagram showing a functional configuration achieved through the execution of a singing voice synthesis program according to the embodiment.

FIG. 9 is a block diagram showing the functional configuration achieved by the CPU 201 executing the singing voice synthesis program 210. As is shown in the figure, by executing the singing voice synthesis program 210, the CPU 201 functions as a singing voice synthesis data editor 211, a sequencer 212, and a singing voice synthesizer 213. In the same figure, as an example, there is shown singing voice synthesis data 310 that is to be edited by the singing voice synthesis data editor 211.

A data format such as VSQ or VSQX is used for singing voice synthesis data 310, and the singing voice synthesis data 310 includes a sequence of note data 311, a sequence of lyrics data 312, and a sequence of sound control data 313. The note data 311 indicates a sequence of notes representing the melody of a song, and more specifically, a sequence of multiple pieces of note data that specify the duration and pitch at which each note is voiced. The lyrics data 312 indicates the lyrics to be sung along with the notes, and more specifically, it is a sequence of multiple pieces of lyrics data indicating names of multiple phonemes that are present in the lyrics. Each of the pieces of lyrics data indicating the phoneme names of the lyrics is associated with at least one of the pieces of note data 311. In other words, each piece of the lyrics data is data indicating the lyrics, or more specifically, data indicating the phoneme names of the lyrics associated with each piece of note data 311 indicating one of the notes included in the sequence of note data 311. The sound control data 313 is a sequence of data for controlling the volume and the pitch at which singing is performed, based on the lyrics indicated by the lyrics data 312 along with the notes indicated by the note data 311.

The singing voice synthesis data editor 211 causes the display 204 to display a Graphical User Interface (GUI) that accepts the input operation of the singing voice synthesis data 310. With the GUI displayed, the user operates the operator 205 to input each of the pieces of singing voice synthesis data 310. The singing voice synthesis data editor 211 stores, in a predetermined storage area within the volatile storage unit 203, the singing voice synthesis data 310 that the user has input by operating the operator 205. Meanwhile, when the user inputs an instruction to store the singing voice synthesis data 310 by operating the operator 205, the singing voice synthesis data editor 211 stores in the non-volatile storage unit 202 the singing voice synthesis data 310 that was stored in the volatile storage unit 203.

As part of a function unique to the present embodiment, the singing voice synthesis data editor 211 has a virtual note data adder 211*a* and a sound control data acquirer 211*b*. In a sequence of note data 311 of the singing voice synthesis data 310, when there is a piece of note data that does not have a contiguous preceding piece of note data, the virtual note data adder 211*a* adds to the sequence of note data 311, a piece of virtual note data that is placed immediately before the piece of note data having no contiguous preceding piece of note data.

Figure 11:
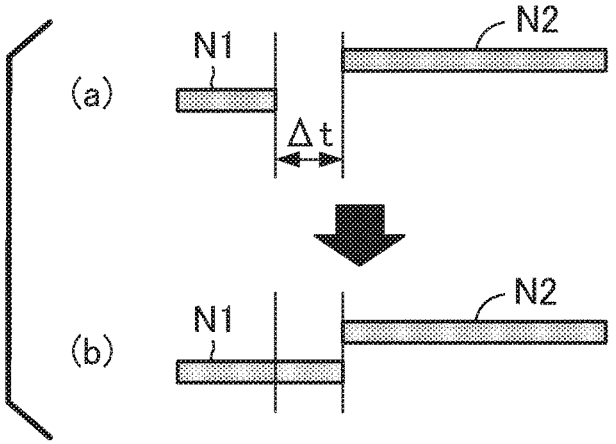
FIG. 11 is a diagram showing details of preprocessing according to the embodiment.
Figure 12:
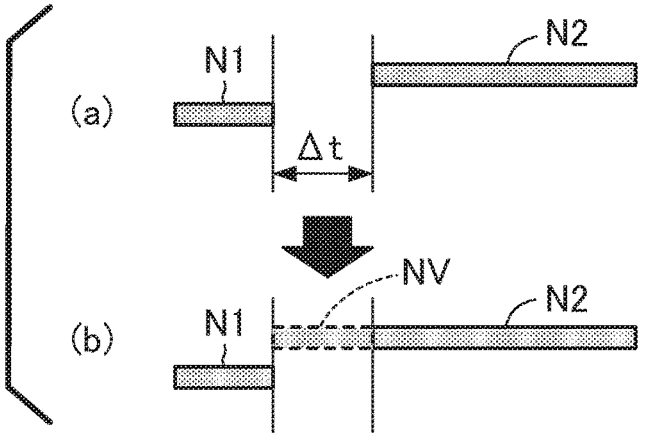
FIG. 12 is a diagram showing details of virtual note data addition according to the embodiment.
Figure 13:
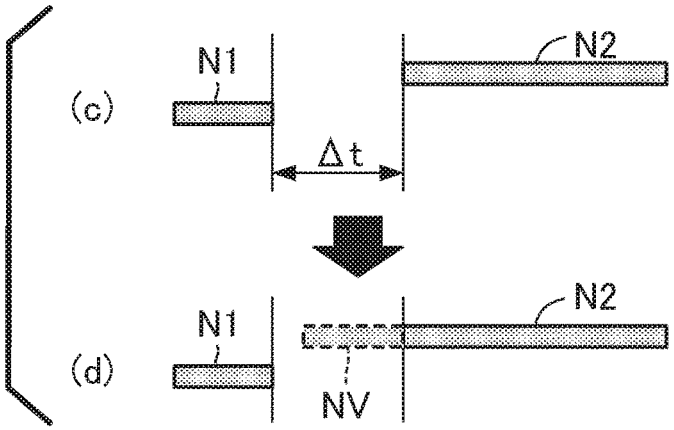
FIG. 13 is another diagram showing the details of virtual note data addition according to the embodiment.

In FIGS. 11 to 13 to be described in detail later, there are shown examples of such addition of virtual note data. This addition of virtual note data is not limited to adding virtual note data to all relevant pieces of note data within the sequence of note data 311 of the singing voice synthesis data 310. In a case in which there are multiple pieces of note data having no contiguous preceding pieces of note data, the addition may be performed relative to a limited number of the multiple pieces of note data. In such a case, the piece(s) of note data to which the addition is performed are selected either by the user, via the operator 205, or by the virtual note data adder 211*a* (i.e., by automatic selection). Alternatively, the user or the virtual note data adder 211*a* may select the note data addition of which is excluded, instead of those to which the addition is performed. The selection by the virtual note data adder 211*a* may be performed according to a predetermined set of conditions, or it may be performed randomly. The sound control data acquirer 211*b* is configured to acquire the sound control data 313 associated with the sequence of note data 311 including the above virtual note data. In other words, the sound control data acquirer 211*b* acquires the sound control data 313 associated with the virtual note data. The sound control data acquirer 211*b* acquires the sound control data 313 in two distinct modes. In the first mode, the sound control data acquirer 211*b* acquires the sound control data 313 that is input by the user's operation of the operator 205. In the second mode, the sound control data acquirer 211*b* first determines an alteration in relative pitch and volume over time, based on the note data 311, the lyrics data 312 and the singing characteristics data Z of a desired singer that has been selected from the singing characteristics database 230. Then the sound control data acquirer 211*b* acquires the sound control data 313 including the pitch control data indicating an alteration in the relative pitch over time, and volume control data indicating an alteration in volume over time.

When the user inputs a singing voice synthesis instruction by operating the operator 205, the sequencer 212, while advancing the relative time that has as its benchmark the starting point of the singing voice synthesis data 310 stored in the volatile storage unit 203, reads out from the volatile storage unit 203 a piece of note data 311 whose relative time is the beginning of the voiced period, as well reading out a piece of lyrics data 312 and a piece of sound control data 313 each of which is associated with the piece of note data 311. The sequencer 212 then supplies to the singing voice synthesizer 213 each of the piece of note data 311, the piece of lyrics data 312, and the volume control data and the pitch control data included in the piece of sound control data 313.

The singing voice synthesizer 213 first reads out from the phoneme database 220 one or more pieces of phoneme waveform data corresponding to the phoneme name(s) indicated by the lyrics data supplied from the sequencer 212. Then by performing pitch conversion on the phoneme waveform data piece(s), the singing voice synthesizer 213 generates phoneme waveform data piece(s) having a pitch obtained by changing the pitch indicated by the piece of note data 311 based on the pitch control data. Subsequently, the singing voice synthesizer 213 performs on the generated phoneme waveform data piece(s) volume control indicated by the volume control data. The singing voice synthesizer 213 smoothly connects along the time axis, the phoneme waveform data pieces thus obtained. In this way, the singing voice synthesizer generates a digital sound signal for Outputting a singing voice (singing waveform data that is in a waveform format), and outputs the generated singing waveform data to the sound system 208. Such is the functional configuration achieved by the execution of the singing voice synthesis program 210.

Operation of the Present Embodiment

Operation of the present embodiment will now be described below.

According to the present embodiment, the user of the singing voice synthesis device 200 may accumulate in the singing characteristics database 230 of the non-volatile storage unit 202 the singing characteristics data. Z of the desired singer generated by the singing analysis device 100. The user of the singing voice synthesis device 200 may use for singing voice synthesis, the singing characteristics data Z of the desired singer stored in the singing characteristics database 230.

When the user of the singing voice synthesis device 200 operates the operator 205 in a predetermined way, the CPU 201 executes the singing voice synthesis program 210. Into the singing voice synthesis data, editor 211 of the singing voice synthesis program 210 there is input, for example by a user operating the operator 205, a piece of note data 311 and one or more pieces of lyrics data 312, which are then stored in a predetermined area within the volatile storage unit 203. The singing voice synthesis data editor 211 of the present embodiment includes a function of editing the sound control data 313 that is associated with the piece of note data 311 and the one or more piece of lyrics data 312.

Figure 10:
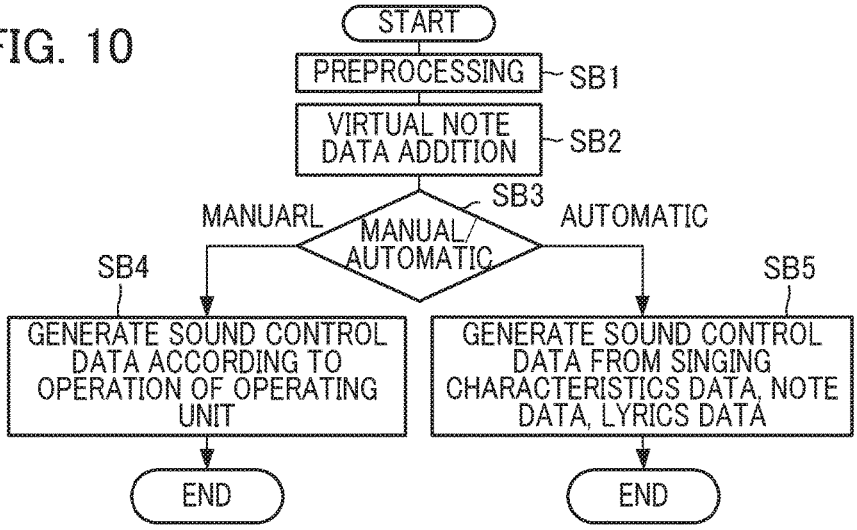
FIG. 10 is a flowchart showing processing details of a singing voice synthesis data editor according to the embodiment.

FIG. 10 is a flowchart illustrating processing details related to the editing function of the sound control data 313 in the singing voice synthesis data editor 211. In this flowchart, step SB2 is processing that corresponds to the virtual note data adder 211*a* in FIG. 9; and steps SB4 and SB5 are processes that correspond to the sound control data acquirer 211*b* in FIG. 9.

First, the CPU 201 performs the preprocessing (SB1). FIG. 11 illustrates details of this preprocessing. In sections (a) and (b) in FIG. 11, the horizontal axes indicate time and the vertical axes indicate pitch. For the piece of note data 311 corresponding to each of the notes constituting a music track, preprocessing is performed to determine a time difference Δt between the note-off timing of the piece of note data N1 and the note-on timing of the subsequent piece of note data N2, as is shown in section (a). When this time difference Δt is less than or equal to a predetermined value, as is shown in section (b), preprocessing is performed to adjust the piece of note data N1 such that the note-off timing of the preceding piece of note data N1 coincides with the note-on timing of the subsequent piece of note data N2. For example, the predetermined value here may be 100 ticks. Meanwhile, in the preprocessing, the user is prompted to implement editing of the sound control data by using the manual-editing mode or by using the automatic-editing mode. In a case that the user selects automatic editing, the user is additionally prompted to select a section(s) on which automatic-editing of the sound control data is to be performed. If no such selection is made by the user, all sections of the music track will be designated for automatic editing of the sound control data. It is of note here that the preprocessing illustrated in FIG. 11 may be omitted.

The CPU 201 performs virtual note data addition (SB2). FIGS. 12 and 13 show examples of processing details of this virtual note data addition, in sections (a) to (d) of FIGS. 12 and 13, the horizontal axes indicate time, and the vertical axes indicate pitch. In the example shown in section (a) in FIG. 12, the time difference Δt between the note-off timing of the preceding piece of note data N1 and the note-on timing of the subsequent piece of note data N2 is within a range of greater than 100 ticks but less than or equal to 120 ticks. In this case, as shown in section (b) in FIG. 12, the virtual note data addition processing generates a piece of virtual note data NV that has, as its note-on timing, the note-off timing of the preceding piece of note data N1, and as its note-off timing, the note-on timing of the subsequent piece of note data N2. In the example shown in section (c) of FIG. 13, the time difference Δt between the note-off timing of the preceding piece of note data N1 and the note-on timing of the subsequent piece of note data N2 is greater than 120 ticks. In this case, as shown in the section (d), the virtual note data addition processing generates a piece of virtual note data NV with a time length of 120 ticks, and that has as its note-off timing the note-on timing of the subsequent piece of note data N2. The note that the virtual note data NV indicates has the same pitch and lyrics as the note that the subsequent note data N2 indicates. The piece of virtual note data NV generated by the virtual note data addition processing is added to the sequence of note data 311 for the purpose of generating sound control data for an unvoiced section before note-on, such as that at the beginning of a phrase. In other words, in the present embodiment, whereas sound control data is generated based on a combination of a respective sequence of note data 311 and the piece(s) of virtual note data NV, the virtual note data piece(s) are used only for generating the sound control data. The virtual note data is never directly supplied to the user or read out by the sequencer 212.

To summarize, as stated above, whereas the singing voice synthesizer 213 generates phoneme waveform data by changing the pitch indicated by the note data 311 based on the pitch control data, the note data 311 here does not include the virtual note data. It is of note here that with regard to the adjustment made to the note data N1 in the preprocessing (the adjustment from section (a) to (b) in FIG. 11), the time difference Δt that constitutes the condition for making the adjustment is less than or equal to 100 ticks. Meanwhile, regarding the virtual note data addition, the time difference Δt that constitutes the condition for performing the addition of the virtual note data NV indicated in section (b) in FIG. 12 is greater than 100 ticks but less than or equal to 120 ticks; whereas the time difference Δt that constitutes the condition for performing the addition of the virtual note data NV indicated in section (d) in FIG. 13 is greater than 120 ticks. These time differences Δt are not limited to the above examples, and other values may be freely chosen and applied as desired. As will be understood from section (b) in FIG. 12 and section (d) in FIG. 13, upon adding the piece of virtual note data NV, the beginning (i.e., the timing at which to begin the voicing, i.e., the starting point of the voiced period) of the piece of virtual note data NV, which is to be added, must come after (later than) the end (the end point of the voiced period) of the preceding piece of note data N1. In so far as this rule is met, the time length of the piece of virtual note data NV to be added is not limited to 120 ticks and may be freely set as desired.

Subsequently, the CPU 201 determines whether the editing mode of the sound control data has been selected by the user as the manual-editing mode or the automatic-editing mode (SB3).

In a case that the user selects the manual-editing mode, the CPU 201 causes the display 204 to display the sequence of note data 311 and the lyrics data 312. The CPU 201 then acquires the sound control data including the volume control data and the pitch control data that the user inputs by operating the operator 205 (SB4). In this case, the user may input sound control data for the section(s) of the virtual note data. It is of note, however, that the virtual note data is not included in the sequence of note data 311 supplied by the sequencer 212.

On the other hand, in a case that the user selects the automatic-editing mode, the CPU 201 generates the sound control data based on the sequence of note data 311, the lyrics data 312 and the singing characteristics data Z of the desired singer selected by the user (SB5).

More specifically, the CPU 201 refers to the sequence of note data 311 to which the virtual note data has been added and segments along the time axis, the melody line of the music track that is the target of singing voice synthesis, into multiple unit sections, each having a unit value (for example, a sixteenth note) that is substantially the same as the aforementioned unit section $U_A$ or $U_A'$. A synthetic music track that is the target of singing voice synthesis is the sequence of note data 311 (the sequence of note data 311 with virtual note data added thereto) of the singing voice synthesis data 310. The CPU 201 segments each of the multiple notes (pieces of note data corresponding to the notes originally included in the sequence of note data 311 and the pieces of virtual note data that have been added) included in this sequence of note data 311. This segmentation is performed in substantially the same manner as in the aforementioned segmentation of the unit section $U_A$ and $U_A'$.

Subsequently, the CPU 201 applies each unit section to the decision tree T[n] of the unit data z[n] corresponding to the n-th state St of the probability model M included in the singing characteristics data Z. By doing so, the CPU 201 specifies an end node vc that the relevant unit section belongs to, among the K number of end nodes vc of the decision tree T[n], and then specifies the sequence of the relative pitches R by using each variable ω (ω0, ω1, ω2, and ωd) of the variable group Ω[k] corresponding to the relevant end node ye among the variable information D[n]. By sequentially executing the above processes for each state St of the probability model M, the sequence of the relative pitches R within the unit section is specified. More specifically, the duration of each state St is set according to the variable cod of the variable group Ω[k], and each relative pitch R is calculated such that the simultaneous probability of the following appearance probabilities is maximized: the appearance probability of the relative pitch R defined by the variable ω0; the appearance probability of the alteration over time ΔR of the relative pitches R defined by the variable ω1; and the appearance probability of the second order differential value $\Delta^2R$ of the relative pitches R defined by the variable ω2. By connecting the sequences of the relative pitches R across multiple unit sections along the time axis, a relative pitch transition CR that extends over the entire synthetic music track is generated. The CPU 201 designates pitch control data indicating a relative pitch transition CR as the sound control data 313.

In the above, a description of the editing of the pitch control data is provided as an example. Editing of the volume control data substantially follows the same steps, and the CPU 201 generates the volume control data indicating the volume transition, which occurs while the singing is performed, based on a sequence of note data 311 with piece(s) of virtual note data added to, the lyrics data 312, and the singing characteristics data Z.

When the user inputs an instruction for singing voice synthesis by operating the operator 205, in the same aforementioned manner, the sequencer 212 supplies to the singing voice synthesizer 213, a piece of note data 311, the lyrics data 312 associated with this piece of note data 311, and the sound control data 313 after reading them out of the volatile storage unit 203. Here, the sound control data 313 includes sound control data that controls the volume and the pitch of the section of the virtual note data.

The singing voice synthesizer 213 first reads out from the phoneme database 220, one or more pieces of phoneme waveform data corresponding to the phoneme names indicated by the lyrics data supplied from the sequencer 212. Then by performing pitch conversion to such phoneme waveform data piece(s), the singing voice synthesizer 213 generates phoneme waveform data piece(s) having a pitch that is obtained by changing the pitch indicated by the piece of note data according to the pitch control data. Subsequently, the singing voice synthesizer 213 performs volume control, indicated by the volume control data, to the generated phoneme waveform data piece(s).

The pitch control data and the volume control data in this case includes the pitch control data and the volume control data corresponding to the section of the virtual note.

Accordingly, by the present embodiment, a variation in pitch and volume according to the singing characteristics of the desired singer may be given to the section immediately before the section having no contiguous preceding note such as a beginning of a phrase. As a result, singing is made more expressive.

The variable extractor 22 and the characteristics analyzer 24 of the singing analysis device 100 (refer to FIG. 1) generates the singing characteristics data Z based on the reference singing data $X_A$, and the reference music track data $X_B$ with virtual note data added thereto. Accordingly, the sound control data acquirer 211*b* may acquire, with a higher probability, the most appropriate sound control data for the virtual note data based on the singing characteristics database 230. This is true when the virtual note data adder 211*a* achieved by the singing voice synthesis program 210 adds the virtual note data to the sequence of note data 311.

Other Embodiments

The above description applies to one embodiment of the present invention, but other embodiments are possible for the present invention. The below are examples of such other embodiments.

(1) The singing voice characteristics data on a volume transition may be generated as follows. First, a music track is divided into unit sections, in the same way as in the aforementioned embodiment. Then the same kinds of information as in the aforementioned embodiment are attributed to each unit section, and machine learning is performed for the probability model that associates the reference music track data $X_B$ with the sequence data of the volume change of the reference singing data $X_A$, and singing characteristics data that defines this probability model is generated.

(2) The singing voice synthesis system according to the aforementioned embodiment may be implemented as a server client system. For example, a server can be permitted to possess the functions of the virtual note data adder 211*a* and the sound control data acquirer 211*b* of the singing voice synthesis device 200, as well as those of the singing analysis device 100, with the client terminal being permitted to possess functions other than the virtual note data adder 211*a* and the sound control data acquirer 211*b* of the singing voice synthesis device 200. The client terminal then performs singing voice synthesis by obtaining from the server sound control data so as to make more expressive the beginning of a phrase. Furthermore, a configuration is possible in which the function of the CPU 12 of the singing analysis device 100 is partially realized by use of exclusive electric circuitry. Similarly, a configuration is possible in which the function of the CPU 201 of the singing voice synthesis device 200 is partially realized by use of exclusive electric circuitry.

DESCRIPTION OF REFERENCE SIGNS

100 . . . singing analysis device, 200 . . . singing voice synthesis device, 12 and 201 . . . CPU, 14 and 202 . . .

non-volatile storage unit, 12 and 203 . . . volatile storage unit, 15 and 206 . . . communication I/F, 204 . . . display, 205 . . . operator, 207 . . . memory I/F, 208 . . . sound system, GA . . . singing analysis program, 22 . . . variable extractor, 24 . . . characteristics analyzer, $X_A$ . . . reference singing data, $X_B$ . . . reference music track data, Z . . . singing characteristics data, 210 . . . singing voice synthesis program, 220 . . . phoneme database, 230 . . . singing characteristics database, 211 . . . singing voice synthesis data editor, 211*a* and 26 . . . virtual note data adder, 211*b* . . . sound control data acquirer, 212 . . . sequencer, 213 . . . singing voice synthesizer, 310 . . . singing voice synthesis data, 311 . . . note data, 312 . . . lyrics data, and 313 . . . sound control data.

What is claimed is:

1. A singing voice synthesis data editing method comprising:

adding to singing voice synthesis data a piece of virtual note data placed immediately before a piece of note data having no contiguous preceding piece of note data, the singing voice synthesis data including: multiple pieces of note data for specifying a duration and a pitch at which each note that is in a time series, representative of a melody to be sung, is voiced; multiple pieces of lyrics data associated with at least one of the multiple pieces of note data; and a sequence of sound control data that directs sound control over a singing voice synthesized from the multiple pieces of lyrics data; and obtaining sound control data that directs sound control over the singing voice synthesized from the multiple pieces of lyrics data, and that is associated with the piece of virtual note data, wherein the adding of the piece of virtual note data includes adding, as the piece of virtual note data, a piece of note data having a time length corresponding to a time difference between the note-on timing of the piece of note data having no contiguous preceding piece of note data and the note-off timing of an immediately preceding note data that is not contiguous, when such a time difference is less than or equal to a predetermined value, and wherein a synthesized sound signal is determined and generated by a singing voice synthesizer based at least in part on the obtained sound control data so as to provide variation in pitch and volume to the singing voice.

2. The singing voice synthesis data editing method according to claim 1, wherein the adding a piece of virtual note data includes adding, as the piece of virtual note data, a piece of note data having a time length corresponding to the predetermined value, when the time difference between the note-on timing of the piece of note data having no contiguous preceding piece of note data and the note-off timing of an immediately preceding note data that is not contiguous exceeds the predetermined value.

3. The singing voice synthesis data editing method according to claim 2, further comprising:

adding, to the singing voice synthesis data, a piece of note data that has a time length corresponding to a time difference between the note-on timing of the piece of note data having no contiguous preceding note data and the note-off timing of an immediately preceding note data that is not contiguous, and that is placed immediately after the preceding piece of note data, when such time difference is less than or equal to another predetermined value shorter than the predetermined value, before adding the piece of virtual note data to the singing voice synthesis data.

4. A singing analysis method comprising:

generating singing characteristics data defining a probability model that causes singing data to be generated from music track data that includes multiple pieces of note data for specifying a duration and a pitch at which each note that is in a time series, representative of a melody to be sung, is voiced, and multiple pieces of lyrics data associated with at least one of the multiple pieces of note data, as well as singing data indicating a singing voice waveform of the music track being sung; and adding, to music track data from which the singing characteristics data is generated, a piece of virtual note data placed immediately before a piece of note data having no contiguous preceding piece of note data, among the multiple pieces of note data, wherein the adding of the piece of virtual note data includes adding, as the piece of virtual note data, a piece of note data having a time length corresponding to a time difference between the note-on timing of the piece of note data having no contiguous preceding piece of note data and the note-off timing of an immediately preceding note data that is not contiguous, when such a time difference is less than or equal to a predetermined value, and wherein a synthesized sound signal is determined and generated by a singing voice synthesizer based at least in part on the generated singing characteristics data so as to provide variation in pitch and volume to a singing voice to be synthesized.

5. A singing voice synthesis data editing device comprising:

memory; and at least one processor configured to execute stored instructions to:

add to singing voice synthesis data a piece of virtual note data placed immediately before a piece of note data having no contiguous preceding piece of note data, the singing voice synthesis data including: multiple pieces of note data for specifying a duration and a pitch at which each note that is in a time series, representative of a melody to be sung, is voiced; multiple pieces of lyrics data associated with at least one of the multiple pieces of note data; and sound control data for directing sound control over a singing voice that is synthesized from the multiple pieces of lyrics data; and acquiring acquire sound control data used for directing the sound control over the singing voice synthesized from the multiple pieces of lyrics data, and that is associated with the piece of virtual note data, wherein the addition of the piece of virtual note data includes adding, as the piece of virtual note data, a piece of note data having a time length corresponding to a time difference between the note-on timing of the piece of note data having no contiguous preceding piece of note data and the note-off timing of an immediately preceding note data that is not contiguous, when such a time difference is less than or equal to a predetermined value, and wherein a synthesized sound signal is determined and generated by a singing voice synthesizer based at least in part on the obtained sound control data so as to provide variation in pitch and volume to the singing voice.

* * * * *